US008681997B2

(12) United States Patent
Karaoguz

(10) Patent No.: US 8,681,997 B2
(45) Date of Patent: Mar. 25, 2014

(54) ADAPTIVE BEAMFORMING FOR AUDIO AND DATA APPLICATIONS

(75) Inventor: Jeyhan Karaoguz, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 1169 days.

(21) Appl. No.: 12/539,774

(22) Filed: Aug. 12, 2009

(65) Prior Publication Data

US 2010/0329489 A1 Dec. 30, 2010

Related U.S. Application Data

(60) Provisional application No. 61/221,903, filed on Jun. 30, 2009.

(51) Int. Cl.
*H04R 5/00* (2006.01)
*H04R 5/02* (2006.01)

(52) U.S. Cl.
USPC ..... 381/17; 381/303; 381/307; 381/96

(58) Field of Classification Search
USPC ..... 381/307, 17–19, 309, 310, 58, 59, 95, 381/96
See application file for complete search history.

(56) References Cited

U.S. PATENT DOCUMENTS

| | | | | |
|---|---|---|---|---|
| 5,394,332 | A * | 2/1995 | Kuwahara et al. | 701/408 |
| 5,440,639 | A * | 8/1995 | Suzuki et al. | 381/17 |
| 5,467,401 | A * | 11/1995 | Nagamitsu et al. | 381/63 |
| 6,859,417 | B1 * | 2/2005 | Houg | 367/96 |
| 7,394,450 | B2 * | 7/2008 | Shibamiya et al. | 345/156 |
| 7,590,460 | B2 * | 9/2009 | Nishioka et al. | 700/94 |
| 7,613,313 | B2 * | 11/2009 | Juppi et al. | 381/306 |
| 7,860,260 | B2 * | 12/2010 | Kim et al. | 381/310 |
| 8,005,228 | B2 | 8/2011 | Bharitkar et al. | |
| 8,385,557 | B2 * | 2/2013 | Tashev et al. | 381/66 |
| 2005/0094821 | A1 | 5/2005 | Bharitkar et al. | |
| 2008/0130923 | A1 * | 6/2008 | Freeman | 381/303 |
| 2009/0028358 | A1 * | 1/2009 | Suzuki | 381/97 |
| 2009/0192707 | A1 * | 7/2009 | Nakatsuka et al. | 701/211 |

* cited by examiner

*Primary Examiner* — Xu Mei
(74) *Attorney, Agent, or Firm* — Brinks Gilson & Lione

(57) ABSTRACT

A system and method for performing efficient directed sound and/or data to a user utilizing position information. Various aspects may, for example, comprise determining position associated with one or more recipients of audio signals, determining one or more audio signal parameters based, at least in part, on such determined position information, and generating audio signals based on such determined audio signal parameters. For example, direction, timing, phasing and/or magnitude of such audio signals may be adapted based on a dynamic recipient positional environment.

36 Claims, 8 Drawing Sheets

ADAPTIVE BEAMFORMING FOR AUDIO AND DATA APPLICATIONS

CROSS-REFERENCE TO RELATED APPLICATIONS/INCORPORATION BY REFERENCE

This patent application is related to and claims priority from provisional patent application Ser. No. 61/221,903 filed Jun. 30, 2009, and titled "ADAPTIVE BEAMFORMING FOR AUDIO AND DATA APPLICATIONS," the contents of which are hereby incorporated herein by reference in their entirety.

FEDERALLY SPONSORED RESEARCH OR DEVELOPMENT

[Not Applicable]

SEQUENCE LISTING

[Not Applicable]

MICROFICHE/COPYRIGHT REFERENCE

[Not Applicable]

BACKGROUND OF THE INVENTION

In a dynamic audio and/or data communication environment, a user may move and/or the characteristics of a recipient group (e.g., an audience for an audio presentation) may change, thereby rendering traditional static audio and/or data signal generation inadequate.

Further limitations and disadvantages of conventional and traditional approaches will become apparent to one of skill in the art, through comparison of such systems with the present invention as set forth in the remainder of the present application with reference to the drawings.

BRIEF SUMMARY OF THE INVENTION

Various aspects of the present invention provide a system and method for providing directed sound and/or data to a user utilizing position information, substantially as shown in and/or described in connection with at least one of the figures, as set forth more completely in the claims. These and other advantages, aspects and novel features of the present invention, as well as details of illustrative aspects thereof, will be more fully understood from the following description and drawings.

DETAILED DESCRIPTION OF VARIOUS ASPECTS OF THE INVENTION

The following discussion will refer to various communication modules, components or circuits. Such modules, components or circuits may generally comprise hardware, software or a combination thereof. Accordingly, the scope of various aspects of the present invention should not be limited by characteristics of particular hardware and/or software implementations of a module, component or circuit unless explicitly claimed as such. For example and without limitation, various aspects of the present invention may be implemented by one or more processors (e.g., a microprocessor, digital signal processor, baseband processor, microcontroller, etc.) executing software instructions (e.g., stored in volatile and/or non-volatile memory). Also for example, various aspects of the present invention may be implemented by an application-specific integrated circuit ("ASIC").

The following discussion may also refer to communication networks and various aspects thereof. For the following discussion, a communication network is generally the communication infrastructure through which a communication device (e.g., a portable communication device) may communicate. For example and without limitation, a communication network may comprise a cellular communication network, a wireless metropolitan area network (WMAN), a wireless local area network (WLAN), a wireless personal area network (WPAN), etc. A particular communication network may, for example, generally have a corresponding communication protocol according to which a communication device may communicate with the communication network. Unless so claimed, the scope of various aspects of the present invention should not be limited by characteristics of a particular type of communication network.

The following discussion will generally refer to audio signals, including parameters of such signals, generating such signals, etc. For the following discussion, an "audio signal" will generally refer to either a sound wave and/or an electronic signal associated with the generation of a sound wave. For example and without limitation, an electrical signal provided to sound-generating apparatus is an example of an "audio signal". Further for example, an audio wave emitted from a speaker is an example of an "audio signal". As another example, an audio signal might be generated as part of a multimedia system, music system, surround sound system (e.g., multimedia surround sound, gaming surround sound, etc.), etc. Note that an audio signal may, for example, be analog or digital. Accordingly, unless so claimed, the scope of various aspects of the present invention should not be limited by characteristics of a particular type of audio signal.

Figure 1A:
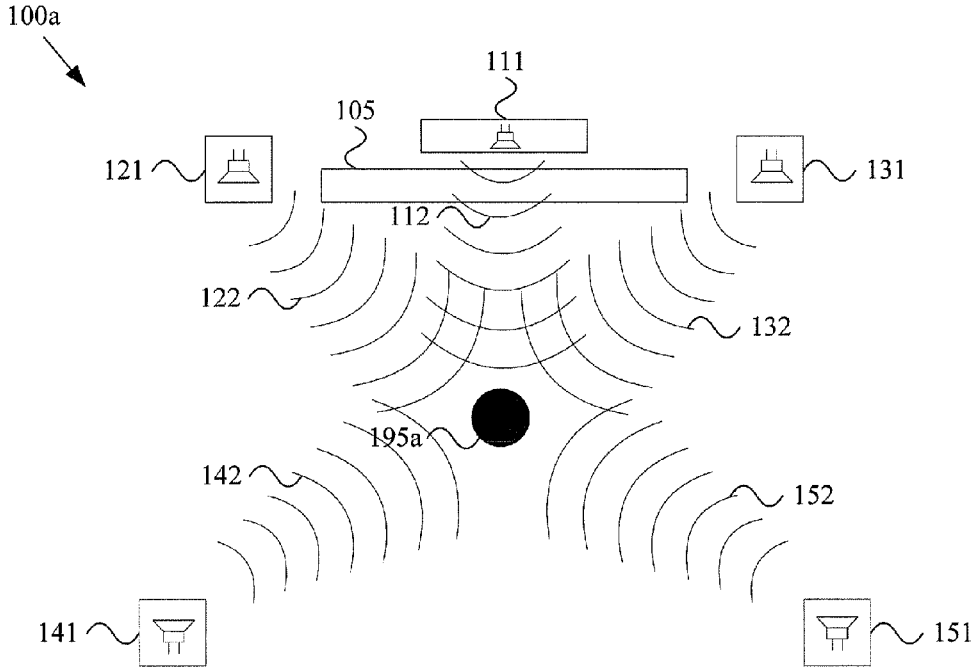
FIG. 1*a* is a diagram illustrating an exemplary multimedia surround-sound operating environment.

FIG. 1*a* is a diagram illustrating an exemplary multimedia surround-sound operating environment 100*a*. The exemplary operating environment 100*a* comprises a video display 105 and various components of a surround sound system (e.g., a 5:1 system, a 7:1 system, etc.). The exemplary surround sound system comprises a front center speaker 111, a front left speaker 121, a front right speaker 131, a rear left speaker 141 and a rear right speaker 151. Each of such speakers outputs an audio signal (e.g., a human-perceptible sound signal), which in turn may be based on an audio signal (electrical, electromagnetic, etc.) received by a speaker. For example, the front center speaker 111 outputs a front center audio signal 112, the front left speaker 121 outputs a front left audio signal 122, the front right speaker 131 outputs a front right audio signal 132, the rear left speaker 141 outputs a rear left audio signal 142, and the rear right speaker 151 outputs a rear right audio signal 152.

In the exemplary environment 100*a*, the surround sound system is a static system. For example, once the system is calibrated the system operates consistently until an operator intervenes to recalibrate the system. For example, in the exemplary environment 100*a*, the surround sound system may be calibrated to provide optimal surround sound quality when a listener is positioned at spot 195*a*. So long as a user is always experiencing the surround sound at location 195*a*, the performance of the surround system will be at or near optimal. For example, the speakers may be configured (e.g., oriented) to direct sound at location 195*a*, and the respective volumes of the speakers may be balanced. Additionally, the timing of sound emitted from the speakers may be balanced (e.g., by positioning speakers at a consistent distance).

Thus, it is seen that so long as a listener is positioned at a known and consistent location, the surround sound experience can be optimized. Suboptimal surround sound performance, however, can be expected when the actual listening environment is not as predicted (i.e., the actually listening environment does not match the environment to which the surround sound system was calibrated).

Figure 1B:
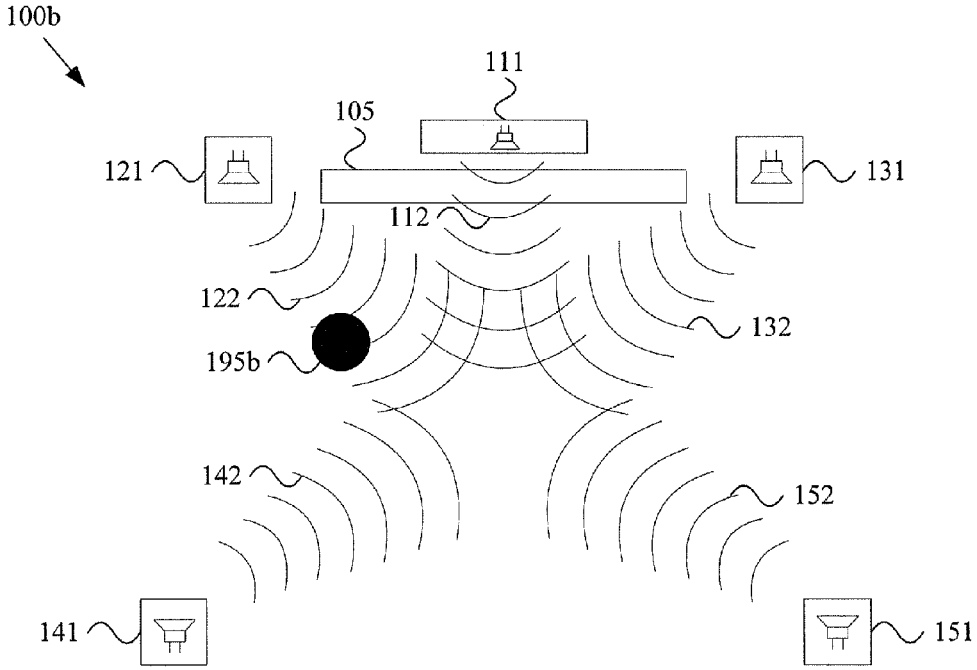
FIG. 1*b* is a diagram illustrating an exemplary multimedia surround-sound operating environment.

FIG. 1*b* is a diagram illustrating another exemplary multimedia surround-sound operating environment 100*b*. The operating environment 100*b* matches the operating environment illustrated in FIG. 1*a*, except that the listener is now positioned at a location different from the optimum position 195*a*. For example, in the exemplary environment 100*b*, the listener is now located at position 195*b*, which is substantially different from the position for which the surround sound system was calibrated (e.g., location 195*a*).

As is apparent from the exemplary operating environment 100*b*, when the surround sound system is calibrated to optimize performance for a listener at location 195*a*, a listener positioned at location 195*b* will experience suboptimal audio performance. For example, a listener positioned at location 195*b* may experience different relative respective volumes from each of the speakers due at least to the change in distance between the listener and the speakers. For example, where in environment 100*a* a listener at position 195*a* is equidistance between the front left speaker 121 and the front right speaker 131, in the environment 100*b* a listener at position 195*b* is over twice as close to the front left speaker 121 than to the front right speaker 131. Such a difference could result in the listener at position 195*b* experiencing much higher sound volume from the front left speaker 121 than from the front right speaker 131. Such volume skew might result in, for example, missed content from the lower-volume speakers, a skewed perception of source location in the surround sound environment, a skewed perception of source motion in the surround sound environment, etc.

Additionally, a listener positioned at location 195*b* (e.g., instead of at the calibrated position 195*a*) may experience sound variations due to the directionality of sound output from the various speakers. For example, the audio signal 132 from the front right speaker 131 is directed at position 195*a*. Movement of a listener to position 195*b* from 195*a* may take the listener to a relatively lower-gain portion of the sound envelope emitted from the front right speaker 131. Thus, for example, the listener will experience directionality-related volume variations in addition to distance-related volume variations. Such variations may, as discussed above, contribute to missed content and/or skewed perception of the intended surround sound environment.

Further, a listener positioned at location 195*b* (e.g., instead of at the calibrated position 195*a*) may experience sound signal timing variations. Although, considering the speed of sound, such timing variations may be relatively minor, such timing variations may (independently or when combined with other factors) contribute to a skewed perception of the intended surround sound environment (e.g., source location, speed and/or acceleration).

Still further, similar to the signal timing concerns discussed above, a listener positioned at location 195*b* (e.g., instead of at the calibrated position 195*a*) will experience phase variations in sound waveforms that arrive at the listener. Such phase variations may, for example, result in unintended and/or unpredictable constructive and/or destructive interference, adversely affecting the listener experience.

Figure 2:
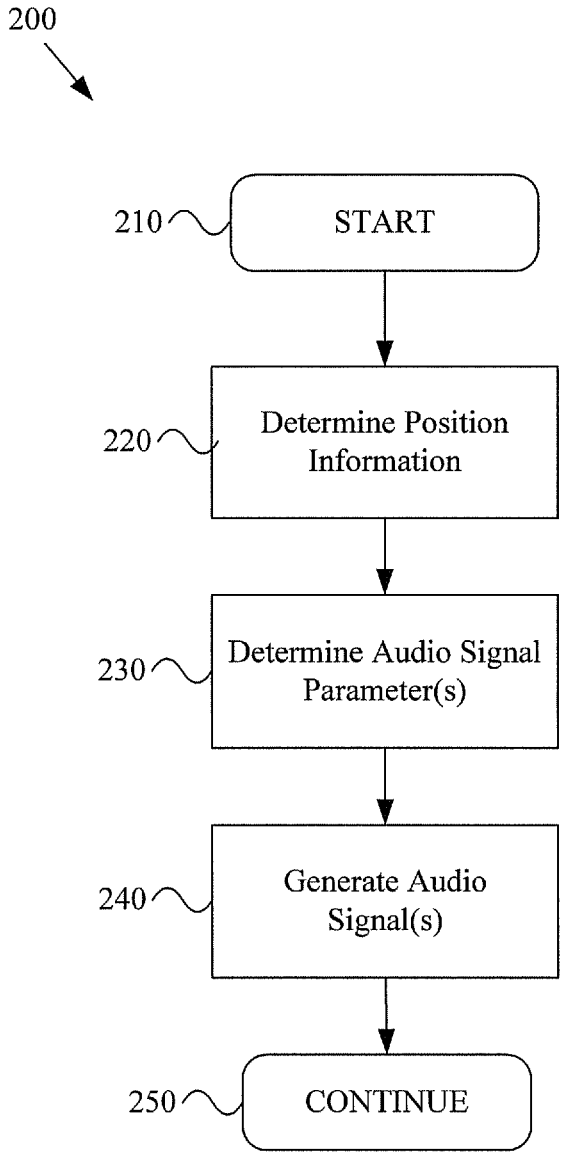
FIG. 2 is a flow diagram illustrating of a method for providing audio signals, in accordance with various aspects of the present invention.

FIG. 2 is a flow diagram illustrating of a method 200 for generating audio signals in accordance with various aspects of the present invention. As will be discussed in more detail later (e.g., with regard to the system illustrated in FIG. 8), any and/or all aspects of the method 200 may be implemented in a wide variety of systems (e.g., a set top box, personal video recorder, video disc player, surround sound audio system, gaming system, television, video display, speaker, stereo, personal computer, etc.).

The exemplary method 200 begins executing at step 210. The method 200 may begin executing in response to any of a variety of causes and/or conditions. For example and without limitation, the method 200 may begin executing in response to a direct user command to execute. Also, for example, the method 200 may begin executing in response to a time-table and/or may execute on a regular periodic (e.g., programmable) basis. Additionally for example, the method 200 may begin executing in response to the beginning of a multimedia presentation (e.g., at movie or game initiation or reset). Further for example, the method 200 may begin executing in response to detected movement in an audio presentation area (e.g., a user moving into the audio presentation area and remaining at a same location for a particular amount of time, or a user exiting the audio presentation area). Accordingly, unless so claimed, the scope of various aspects of the present invention should not be limited by characteristics of a particular type of audio signal.

The exemplary method 200 may, at step 220, comprise determining position information associated with a destination for sound (or another type of signal, such as a data signal, in other embodiments). For example, such position information may comprise absolute and/or relative position information. Also for example, such position information may comprise position coordinate information (e.g., a world coordinate system, a local premises coordinate system, a sound presentation area coordinate system, a gaming coordinate system, etc.). As a non-limiting example, in a surround sound system, step 220 may comprise determining a position in a room at which the surround sound experience is to be optimized. For example, step 220 may comprise determining a position in a room at which respective audio waves from a plurality of speakers are to be directed and/or time and/or phase synchronized.

Step 220 may comprise determining position information associated with a destination for sound in any of a variety of manners, non-limiting examples of which will now be provided.

For example, step 220 may comprise determining a location (or position) of an electronic device. The electronic device may, for example, be carried by and/or associated with a listener. Such an electronic device may, for example and without limitation, comprise a remote control device (e.g., multimedia system remote control, television remote control, universal remote control, gaming control, etc.), a personal computing device, a personal digital assistant, a cellular and/or portable telephone, a personal locating device, a Global Positioning System device, an electronic device specifically designed to identify a target location for surround sound, a personal media device, etc.

Step 220 may, for example, comprise receiving location information from an electronic device associated with a user. For example, an electronic device (e.g., any of at least the devices enumerated above) may communicate information of its location to a system (or component thereof) implementing step 220. As a non-limiting example, a television remote control or gaming controller being utilized by a user may communicate information of its position to the system implementing step 220. Such position information may be communicated directly with the system or through any of a wide variety of communication networks, some of which were listed above.

In another exemplary scenario, a portable (e.g., cellular) telephone carried by a user may communicate information of its position to the system implementing step 220. Such communication may occur through a direct wireless link between the telephone and the system, through a wireless local area network or through the cellular network.

In another exemplary scenario, a surround sound calibration device may be specifically designed to be placed at a focal point in a room for surround sound. Such device may then, for example, communicate information of its position to the system (or component thereof) implementing step 220.

Such an electronic device may determine its location in any of a variety of manners. For example, such an electronic device may determine its location utilizing satellite positioning systems, metropolitan area triangulation systems, a premises-based triangulation system, etc.

Step 220 may, for example, comprise determining position information by, at least in part, utilizing a premises-based position-determining system. For example, such a premises-based system may be based on 60 GHz and/or UltraWideband (UWB) positioning technology. An example of such a system is illustrated in FIG. 3.

Figure 3:
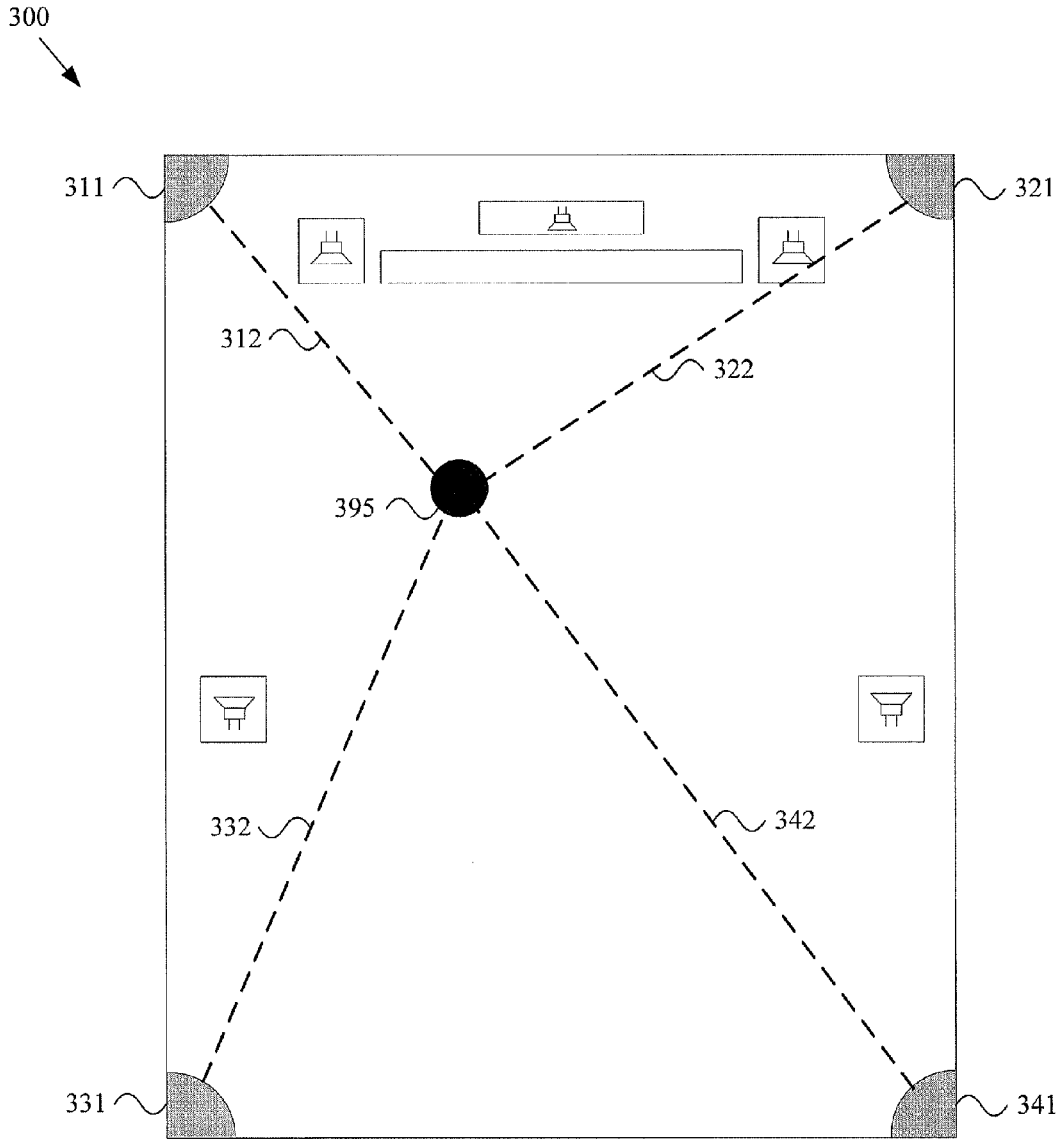
FIG. 3 is a diagram illustrating position determining, in accordance with various aspects of the present invention.

FIG. 3 is a diagram illustrating position determining (e.g., as may be performed at step 220), in accordance with various aspects of the present invention. In the illustrated scenario 300, a sound presentation area (e.g., one or more rooms of a premises associated with a multimedia entertainment system) may comprise a first positioning pod 311, second positioning pod 321, third positioning pod 331 and fourth positioning pod 341. Such positioning pods may, for example, be based on various wireless technologies (e.g., RF and/or optical technologies).

In a radio frequency example, the first positioning pod 311 may establish a first wireless communication link 312 with an electronic device at location 395. Similarly, the second positioning pod 321 may establish a second wireless communication link 322 with the electronic device at location 395, the third positioning pod 331 may establish a third wireless communication link 332 with the electronic device at location 395, and the fourth positioning pod 341 may establish a fourth wireless communication link 342 with the electronic device at location 395. Note that a four-pod implementation (e.g., as opposed to a three-pod, two-pod or one-pod implementation) may include redundant positioning information, but may enhance accuracy and/or reliability of the position determination. High frequency operation (e.g., at 60 GHz) may provide for very short wavelengths or pulses, which may in turn provide for a relatively high degree of position-determining accuracy.

Another exemplary position-determining system may be based on signal reflection technology (e.g., in which communication with an electronic device associated with a user is not necessary). In such an exemplary scenario, the first positioning pod 311 may transmit a signal 312 (e.g., an optical signal, acoustical signal or wireless radio signal) that may reflect off a listener or multiple listeners in the sound presentation area. Such a reflected signal may then, for example, be received and processed (e.g., by delay time and/or phase measurement processing) to determine the location 395.

In such a scenario (i.e., involving a position-determining system external to a listener and/or electronic device associated with the listener, step 220 may comprise receiving positioning information directly from the position-determining system (e.g., via direct link or through an intermediate communication network). In another scenario, such a position-determining system may communicate determined position information to an electronic device associated with the listener which may, in turn, forward such position information to the system implementing step 220).

Figure 4:
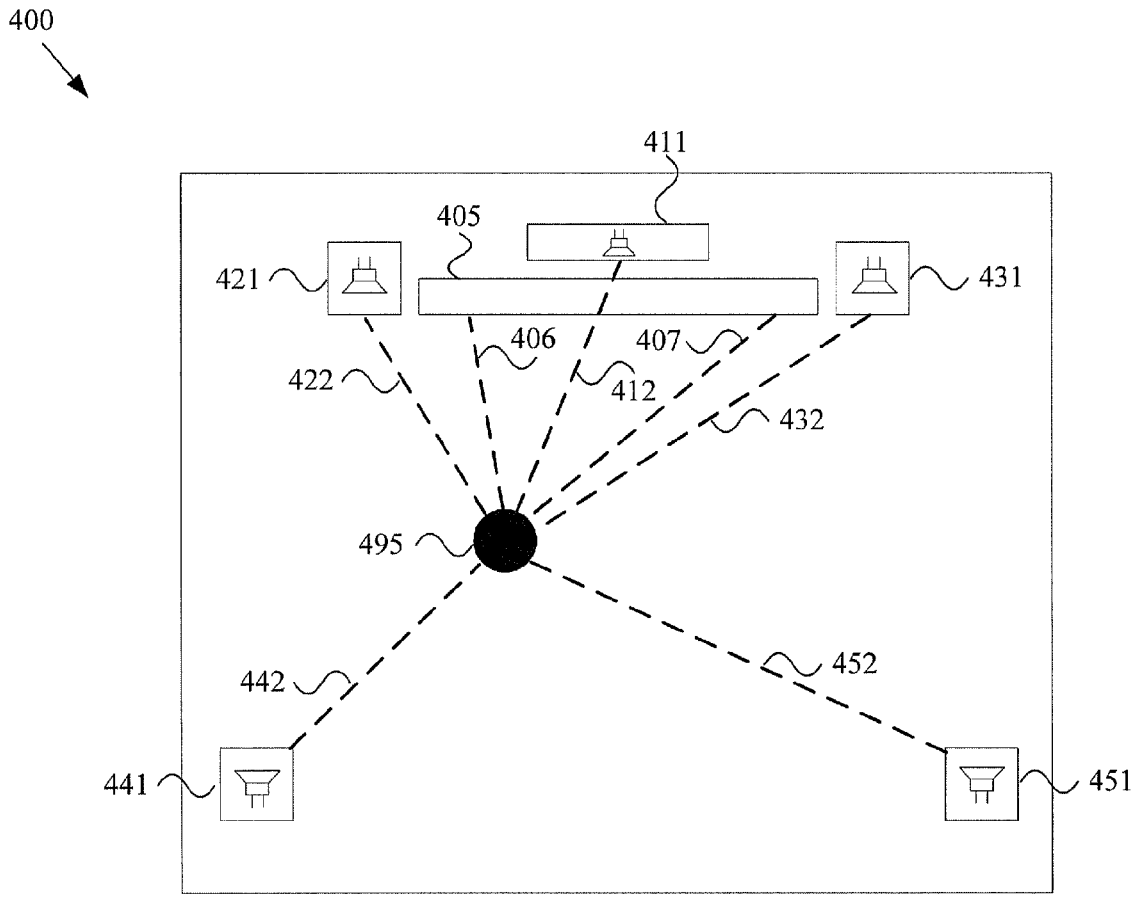
FIG. 4 is a diagram illustrating position determining, in accordance with various aspects of the present invention.

Yet another example of position-determining (e.g., as may be performed at step 220) is illustrated in FIG. 4, which shows a diagram illustrating position determining, in accordance with various aspects of the present invention. FIG. 4 illustrates a position-determining environment 400, where various components of an audio and/or video presentation system participate in the position-determining process.

For example, the exemplary environment 400 comprises a five-speaker surround sound system. Such system includes a front center speaker 411, front left speaker 421, front right speaker 431, rear left speaker 441 and rear right speaker 451. In such an exemplary environment, each of the speakers comprises position detection sensors (e.g., receivers and/or transmitters), which may share any of the characteristics with the pods 311, 321, 331 and 341 discussed previously with regard to FIG. 3.

For example, the front left speaker 421 may comprise a first position-determining sensor that transmits and/or receives a signal 422 utilized to determine a listener location 495. Similarly, the front center speaker 411 and front right speaker 431 may comprise respective position-determining sensors that transmit and/or receive respective signals 412, 432 utilized to determine the listener location 495. Likewise, the rear left speaker 441 and rear right speaker 451 may comprise respective position-determining sensors that transmit and/or receive respective signals 442, 452 utilized to determine the listener location 495. The various speakers and/or sensors may then be aggregated by a central position-determining system, which may for example be integrated in the surround sound system or may be an independent stand-alone unit. For example, such a central system may process signals received from the speakers 411, 421, 431, 441 and 451 and determine (e.g., utilizing triangulation techniques) the position of the listener (or other location to which surround sound should be targeted).

In a manner similar to the speaker-centric position-determining capability just discussed, the exemplary environment 400 also illustrates a video display 405 (or television) with position-determining capability. For example, the video display 405 may comprise one or more onboard position-determining sensors that transmit and/or receive signals (e.g., signals 406 and 407) which may be utilized to determine a listener location 495 (or other target for sound presentation). In other exemplary scenarios, such position-determining sensors may be integrated in a cable television set top box, personal video recorder, satellite receiver, gaming system or any other component.

Figure 5:
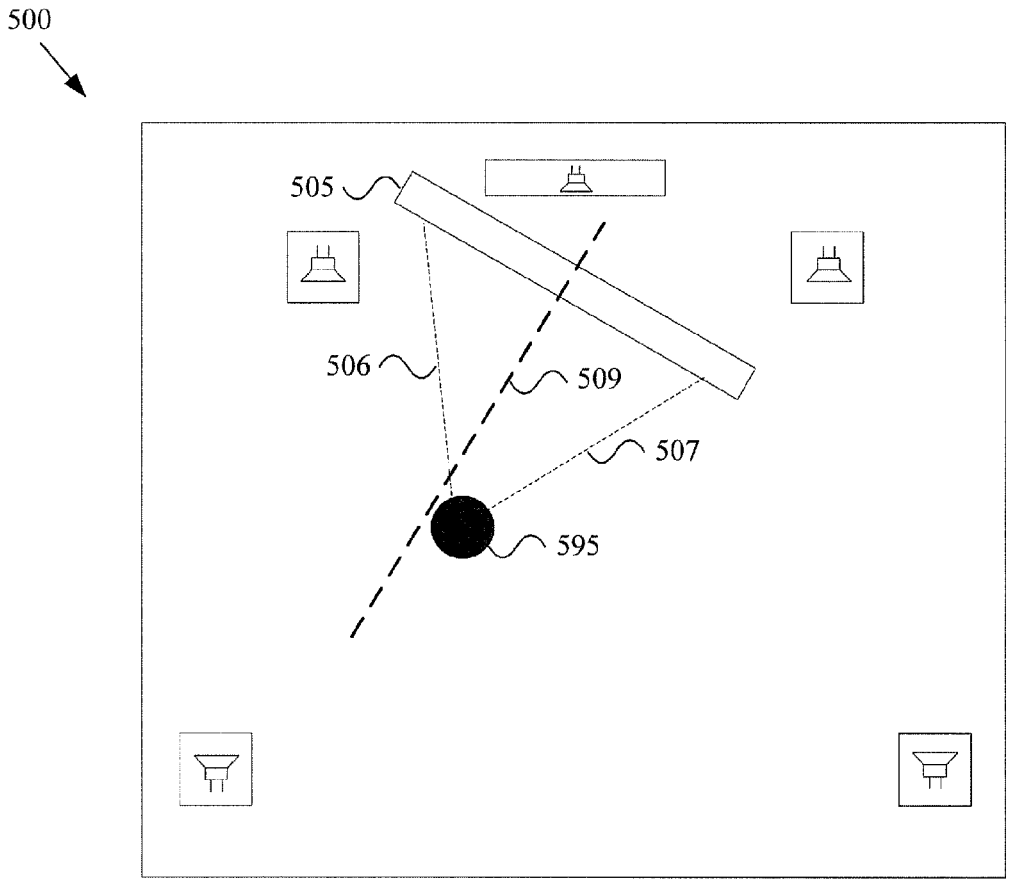
FIG. 5 is a diagram illustrating position determining, in accordance with various aspects of the present invention.

Yet another example of position-determining (e.g., as may be performed at step 220) is illustrated in FIG. 5, which shows a diagram illustrating position determining, in accordance with various aspects of the present invention. FIG. 5 illustrates a position-determining environment 500, in which video display orientation is utilized to determine a target position (or at least direction) for sound presentation.

The exemplary environment 500 may, for example, comprise a video display 505 (or television) with orientation-determining capability. For example and without limitation, such orientation-determining capability may be provided by optical position encoders, resolvers, potentiometers, etc. Such sensors may, for example, be coupled to movable joints in the video display system (e.g., on a video display mounting system) and track angular and/or linear position of such movable joints. In such an exemplary environment 500, assumptions may be made about the location of an audio listener. For example, it may be assumed that a listener is generally located in front of the video display 505 (e.g., along the main viewing axis 509 of the display 505). Such assumption may then be utilized independently to estimate listener position (e.g., combined with a constant estimated range number, for example, eight feet in front of the video display 505 along the main viewing axis 509), or may be used in conjunction with other position-determining information.

For example, the exemplary video display 505 may also comprise one or more receiving and/or transmitting sensors (such as those discussed previously) to locate the listener at a location 595 that is generally along the viewing axis 509. Though the exemplary scenario 500 illustrates the video display 505 utilizing two of such sensors with associated signals 506 and 507, various other embodiments may comprise utilizing a single range sensor pointing generally along the viewing axis 509, or may comprise utilizing more than two sensors.

Figure 7:
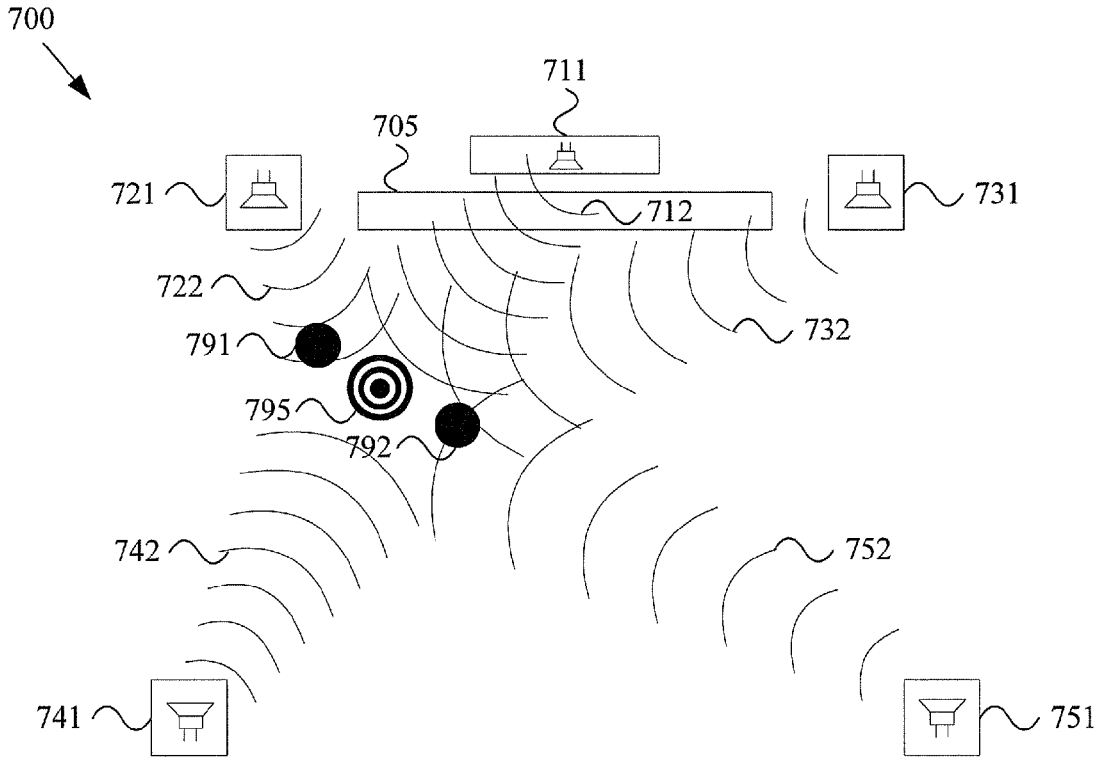
FIG. 7 is a diagram illustrating an exemplary multimedia surround-sound operating environment, in accordance with various aspects of the present invention.

Yet another non-limiting example of position-determining is illustrated at FIG. 7, which illustrates position-determining (e.g., as may be performed at step 220), in accordance with various aspects of the present invention. FIG. 7 illustrates a position-determining environment 700 that includes a plurality of listeners, including a first listener 791 and a second listener 792.

In such a scenario, step 220 may comprise determining respective positions of a plurality of listeners (e.g., the first listener 791 and the second listener 792). Step 220 may then, for example, comprise determining a destination position (or target position) for sound based, at least in part, on the respective positions. In a first non-limiting example, step 220 may comprise selecting a destination position from between a plurality of determined listener positions (e.g., selecting a highest priority listener, a listener that is the most directly in-line with a main axis of the video display, a listener that is the closest to the video display, etc.

In a second non-limiting example, step 220 may comprise determining a position that is different any of the determined listener positions. For example, as illustrated in FIG. 7, step 220 may comprise determining a sound destination (or target) position 795 that is centered between the plurality of determined listener positions. As a non-limiting example, step 220 may comprise determining a midpoint, or "center of mass", between the plurality of listener positions. Alternatively, for example, the determined sound destination position may be based on a determined midpoint, but then skewed in a particular direction (e.g., toward the main viewing axis of the display, toward the closest viewer, toward a position of a remote control, toward a higher-priority or specific listener, etc.).

In general, step 220 may comprise determining position information associated with a destination for sound in any of a variety of manners, many non-limiting examples of which were provided above. Accordingly, unless explicitly claimed, the scope of various aspects of the present invention should not be limited by characteristics of any particular manner.

The exemplary method 200 may, at step 230, comprise determining (e.g., based at least in part on the position information determined at step 220) at least one audio signal parameter.

Figure 6:
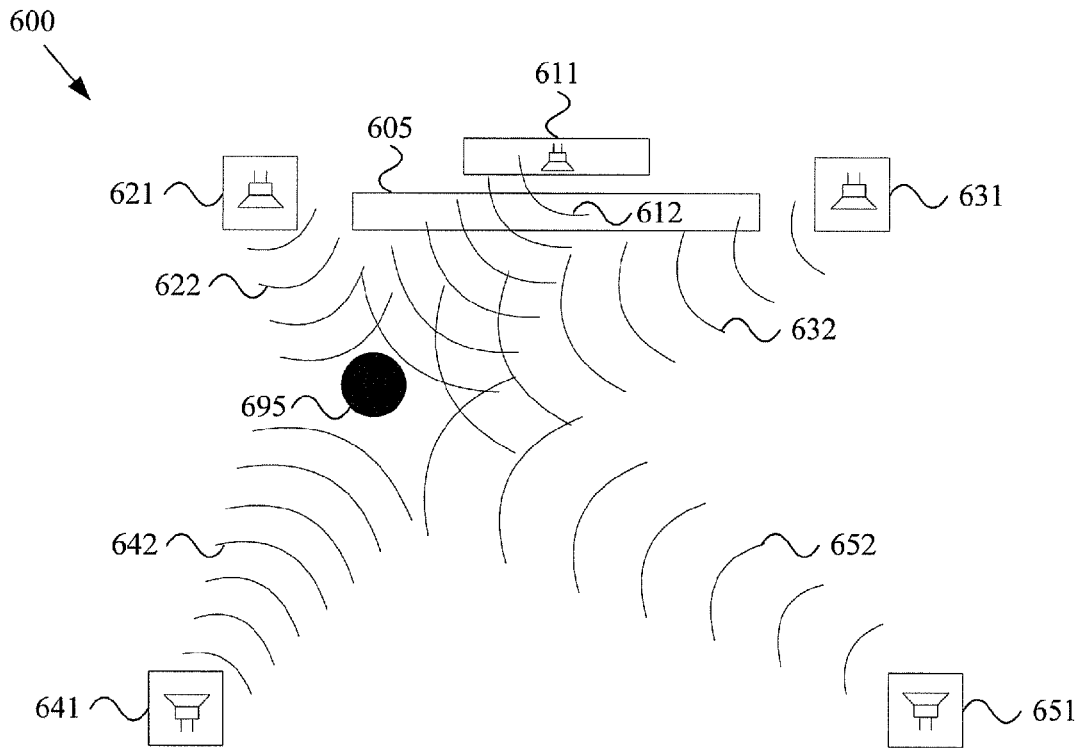
FIG. 6 is a diagram illustrating an exemplary multimedia surround-sound operating environment, in accordance with various aspects of the present invention.

As illustrated in FIG. 1*b* and discussed previously, a listener position 195*b* that is different from the sound destination position 195*a* to which the sound system was calibrated may result in a suboptimal listener experience (e.g., a surround sound experience). Step 230 comprises determining one or more audio signal parameters based, at least in part, on a determined destination (or target) position for delivered sound. For example, the generated sound may be directed, timed and/or phased in accordance with a determined sound destination position (or direction). FIG. 6 provides an exemplary illustration.

FIG. 6 is a diagram illustrating an exemplary multimedia surround-sound operating environment 600, in accordance with various aspects of the present invention. The exemplary operating environment 600 comprises a video display 605 and various components of a surround sound system (e.g., a 5:1 system, a 7:1 system, etc.). The exemplary surround sound system comprises a front center speaker 611, a front left speaker 621, a front right speaker 631, a rear left speaker 641 and a rear right speaker 651. Each of such speakers outputs an audio signal (e.g., a human-perceptible sound signal), which in turn is based on an audio signal (e.g., electrical, electromagnetic, etc.) received by a speaker. For example, the front center speaker 611 outputs a front center audio signal 612, the front left speaker 621 outputs a front left audio signal 622, the front right speaker 631 outputs a front right audio signal 632, the rear left speaker 641 outputs a rear left audio signal 642, and the rear right speaker 651 outputs a rear right audio signal 652.

In the exemplary environment 600, unlike the exemplary environment 100*b* illustrated in FIG. 1*b*, such exemplary environment 600 comprises an audio presentation system that has been calibrated, in accordance with various aspects of the present invention (e.g., adjusted, tuned, synchronized, etc.), to the sound destination position 695. As discussed previously, position 695 may be the location of a listener or may be a destination position (e.g., a focal point) determined based on any of a number of criteria, including but not limited to determined audio destination information.

Step 230 may comprise determining any of a variety of audio signal parameters. The following discussion will present various non-limiting examples of such audio signal parameters. Such audio signal parameters are generally determined to enhance the sound experience (e.g., surround sound experience, music stereo experience, etc.) of one or more listeners in an audio presentation area.

For example, as discussed previously in the discussion of FIG. 1*b*, if the system is not calibrated (e.g., re-optimized) for the positioning 195*b* of the listener, the listener may experience an unintended volume disparity between various speakers, resulting in a reduced quality sound experience.

Referring to FIG. 6, to address such volume-related issues, step 230 may comprise determining relative audio signal strengths (e.g., relative audio volumes) based, at least in part, on the sound destination position 695. Step 230 may, for example, comprise determining a plurality of audio signal strengths associated with a respective plurality of audio speakers. For example, step 230 may comprise determining a plurality of audio signal strengths associated with a respective plurality of audio signals from a respective plurality of audio speakers, such that a particular sound associated with the plurality of audio signals arrives at a target destination 695 at a same volume from each of the respective plurality of audio speakers. Thus, when a listener is intended to hear a sound equally well from the left and right sides, a listener located at the sound destination 695 will experience such equal left/right volume, even though positioned relatively closer to the left speakers 621, 641 than to the right speakers 631, 651. Similarly, when a listener is intended to hear a sound equally well from the front and rear, a listener located at the sound destination 695 will experience such equal front/rear volume, even though positioned relatively closer to the front speakers 621, 631 than to the rear speakers 641, 651.

Step 230 may comprise determining the relative audio signal strengths in any of a variety of manners. For example and without limitation, step 230 may comprise determining such audio signal strengths based on the position of the sound destination 695 in respective audio gain patterns associated with each respective speaker. In another example, step 230 may comprise determining such respective audio signal strengths based merely on respective distance between the sound destination 695 and each respective speaker.

Also for example, as discussed previously in the discussion of FIG. 1*b*, if the system is not calibrated (e.g., re-optimized) for the positioning 195*b* of the listener, the listener may experience unintended audio effects due to audio directionality issues associated with the various speakers, resulting in a reduced quality sound experience.

Referring to FIG. 6, to address such volume-related issues, step 230 may comprise determining relative audio signal directionality based, at least in part, on the sound destination position 695. Step 230 may, for example, comprise determining a plurality of audio signal directions associated with a respective plurality of audio speakers (e.g., directional audio speakers). For example, step 230 may comprise determining a plurality of audio signal directions associated with a respective plurality of audio signals such that respective sound emitted from the plurality of audio speakers is directed to the target destination 695. Note that such directionality may also be a factor in the audio signal strength determination discussed above.

Thus, when a listener is intended to hear a sound equally well from the left and right sides, a listener located at the sound destination 695 will experience such equal left/right volume, even though positioned at different respective angles to the left 621, 641 and right 631, 651 speakers. Similarly, when a listener is intended to hear a sound equally well from the front and rear, a listener located at the sound destination 695 will experience such equal front/rear volume, even though positioned at different respective angles to the front 611, 621, 631 and rear 641, 651 speakers.

Such sound direction calibration is illustrated graphically in FIG. 6 by the exemplary sound signals 612, 622, 632, 642 and 652 being directed to the sound destination 695. Note that step 230 may comprise determining directionality-related audio signal parameters in any of a variety of manners (e.g., depending on the audio system architecture). For example and without limitation, directionality of an audio signal may be established utilizing a phased-array type of approach, in which a plurality of sound emitters are associated with a single speaker. In such an exemplary system, step 230 may comprise determining respective signal strength and timing for the sound emitters based on such phased-array techniques. In another exemplary scenario, directionality of transmitted sound may be controlled through respective sound transmission from a plurality of speakers. In such an exemplary system, step 230 may comprise determining respective signal strength and timing for the plurality of speakers. In yet another exemplary scenario, the speakers might be automatically moveable. In such an exemplary scenario, step 230 may comprise determining pointing directions for the various speakers. Note that such directionality calibration may be related to the signal strength calibration discussed previously (e.g., by modifying signal gain patterns).

Also for example, as discussed previously in the discussion of FIG. 1*b*, if the system is not calibrated (e.g., re-optimized) for the positioning 195*b* of the listener, the listener may experience unintended audio effects due to audio timing and/or synchronization issues associated with the various speakers, resulting in a reduced quality sound experience.

Referring to FIG. 6, to address such timing-related issues, step 230 may comprise determining relative audio signal timing based, at least in part, on the sound destination position 695. Step 230 may, for example, comprise determining a plurality of audio signal timings associated with a respective plurality of audio speakers. For example, step 230 may comprise determining a plurality of audio signal timings associated with a respective plurality of audio signals such that respective sound emitted from the plurality of audio speakers is timed to arrive at the target destination 695 in a time-synchronized manner. Note that such timing may also be a factor in the audio signal directionality determination discussed above.

Thus, when a listener is intended to hear sounds from the left and right sides with a particular relative timing, a listener located at the sound destination 695 will experience sound at the appropriate timing, even though positioned at different respective angles and/or distances to the left 621, 641 and right 631, 651 speakers. Similarly, when a listener is intended to hear sounds from the front and rear with a particular relative timing, a listener located at the sound destination 695 will experience sound at the appropriate timing, even though positioned at different respective angles and/or distances to the front 611, 621, 631 and rear 641, 651 speakers.

Such audio signal timing calibration is illustrated graphically in FIG. 6 by wave fronts of the exemplary sound signals 612, 622, 632, 642 and 652 arriving at the sound destination 695 in a time-synchronized manner. Note that step 230 may comprise determining timing-related audio signal parameters in any of a variety of manners (e.g., depending on the audio system architecture). For example and without limitation, step 230 may comprise determining audio signal timing adjustments relative to a baseline (or "normal") time. Also for example, step 230 may comprise determining relative audio signal timing between a plurality of audio signals associated with a plurality of respective independent speakers. Additionally for example, step 230 may comprise calculating respective expected time for sound to travel from a respective source speaker to the destination 695 for each speaker.

In an exemplary embodiment where one or more speakers each comprise a plurality of sound-emitting elements (e.g., as discussed previously in the discussion of directionality), step 230 may comprise determining timing parameters for each sound-emitting element of each speaker. For example, step 230 may comprise determining relative audio signal timing between a plurality of audio signals associated with a respective plurality of sound emitting elements of a single speaker.

In another exemplary scenario, step 230 may comprise determining relative audio signal timing between a plurality of audio signals corresponding to a respective plurality of audio speakers such that a particular sound associated with the plurality of audio signals arrives at the target destination 695 from the respective plurality of speakers simultaneously.

Further for example, as discussed previously in the discussion of FIG. 1*b*, if the system is not calibrated (e.g., re-optimized) for the positioning 195*b* of the listener, the listener may experience unintended audio effects due to audio signal phase variations, resulting in a reduced quality sound experience.

Referring to FIG. 6, to address such phase-related issues, step 230 may comprise determining relative audio signal phase based, at least in part, on the sound destination position 695. Step 230 may, for example, comprise determining a plurality of audio signal phases associated with a respective plurality of audio speakers. For example, step 230 may comprise determining a plurality of audio signal phases associated with a respective plurality of audio signals such that respective sound emitted from the plurality of audio speakers arrives at the target destination 695 with a desired phase relationship.

Thus, when respective audio signals are intended to arrive at a listener from different speakers with a particular phase relationship from the left and right sides, a listener located at the sound destination 695 will experience such audio signals at the appropriate relative phase, even though positioned at different respective angles and/or distances to the left 621, 641 and right 631, 651 speakers. Similarly, when respective audio signals are intended to arrive at a listener from different speakers with a particular phase relationship from the front and rear, a listener located at the sound destination 695 will experience such audio signals at the appropriate relative phase, even though positioned at different respective angles and/or distances to the front 611, 621, 631 and rear 641, 651 speakers.

Step 230 may comprise determining phase-related audio signal parameters in any of a variety of manners (e.g., depending on the audio system architecture). For example and without limitation, step 230 may comprise determining audio signal phase adjustments relative to a baseline (or "normal") phase. Also for example, step 230 may comprise determining relative audio signal phase between a plurality of audio signals associated with a plurality of respective independent speakers. Additionally for example, step 230 may comprise calculating respective expected time for an audio signal to travel from a respective source speaker to the destination 695 and the phase at which such an audio signal is expected to arrive at the destination 695. Phase and/or timing adjustments may then be made accordingly.

In general, step 230 may comprise determining (e.g., based at least in part on the position information determined at step 220) at least one audio signal parameter. Various non-limiting examples of such determining were provided above for illustrative purposes only. Accordingly, unless explicitly claimed, the scope of various aspects of the present invention should not be limited by characteristics of any particular audio signal parameter nor by characteristics of any particular manner of determining an audio signal parameter.

The exemplary method 200 may, at step 240, comprise generating one or more audio signals based, at least in part, on the determined at least one audio signal parameter (e.g., as determined at step 230). Such generating may be performed in any of a variety of manners (e.g., depending on the nature of the one or more audio signals being generated).

For example and without limitation, in a scenario where the audio signal is an acoustical wave, step 240 may comprise generating the audio signal utilizing a speaker (e.g., a voice coil, array of sound emitters, etc.). Also for example, in a scenario where the audio signal is an electrical driver signal to a speaker (or other acoustic wave generating device), step 240 may comprise generating such electrical driver signal with electrical driver circuitry. Further for example, in a scenario where the audio signal is a digital audio signal, step 240 may comprise generating such a digital audio signal utilizing digital circuitry (e.g., digital signal processing circuitry, encoding circuitry, etc.).

Step 240 may, for example, comprise generating signals at various respective magnitudes to control audio signal parameters associated with various volumes. Step 240 may also, for example, comprise generating audio signals having various timing characteristics by utilizing various signal delay technology (e.g., buffering, filtering, etc.). Step 240 may further, for example, comprise generating audio signals having various directionality characteristics by adjusting timing and/or magnitude of various signals. Additionally, step 240 may, for example, comprise generating audio signals having particular phase relationships by adjusting timing and/or phase of such signals (e.g., utilizing buffering, filtering, phase locking, etc.). In another example, step 240 may comprise generating control signals controlling physical speaker orientation.

In general, step 240 may comprise generating one or more audio signals based, at least in part, on one or more audio signal parameters (e.g., as determined at step 230). Accordingly, unless explicitly claimed, the scope of various aspects of the present invention should not be limited by any particular manner of generating an audio signal.

The exemplary method 200 may, at step 250, comprise continuing operation. For example, as discussed previously, the exemplary method 200 may be executed periodically and/or in response to particular causes and conditions. Step 250 may, for example, comprise managing repeating operation of the exemplary method 200.

For example, in a non-limiting exemplary scenario, step 250 may comprise detecting a change in the listener situation in the sound presentation area (e.g., entrance of new listener into the area, exiting of a listener from the area, movement of a listener from one location to another, rotation of the video monitor, etc.). In response, step 250 may comprise looping execution of the exemplary method 200 back up to step 220 for re-determining position information, re-determining audio signal parameters, and continued generation of audio signals based, at least in part, the newly determined audio signal parameters. Note that in such an exemplary scenario, step 250 may comprise utilizing various timers to determine whether the listener situation has indeed changed, or whether the apparent change in listener make-up was a false alarm (e.g., a person merely passing through the audio presentation area, rather than remaining in the audio presentation area to experience the presentation).

In another example, step 250 may comprise determining that a periodical timer has expired indicating that it is time to perform a periodic recalibration processes (e.g., re-execution of the exemplary method 200). In response to such timer expiration, step 250 may comprise returning execution flow of the exemplary method 200 to step 220. Note that in such an example, the period (or other timetable) at which re-execution of the exemplary method 200 is performed may be specified by a user, after which recalibration may be performed periodically or on another time table (or based on other causes and/or conditions) automatically (i.e., without additional interaction with the user).

Figure 8:
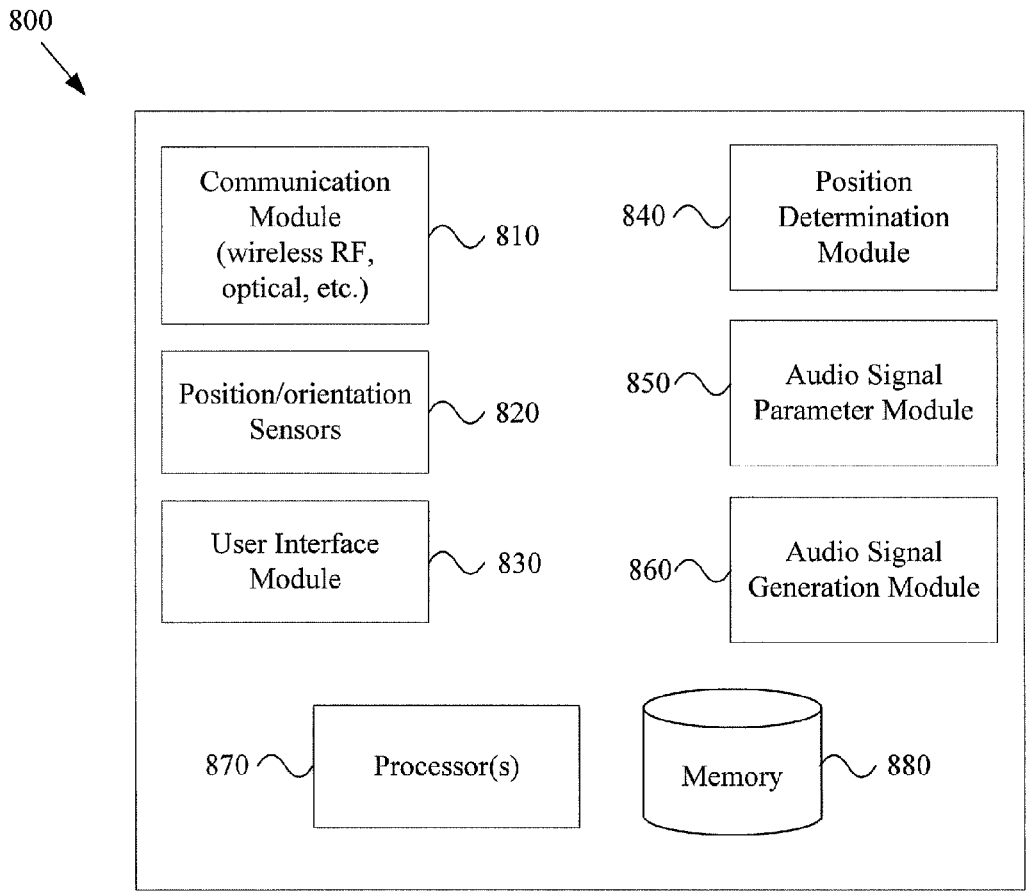
FIG. 8 is a diagram illustrating a non-limiting exemplary block diagram of a signal-generating system, in accordance with various aspects of the present invention.

Turning next to FIG. 8, such figure is a diagram illustrating a non-limiting exemplary block diagram of an audio signal generating system 800, in accordance with various aspects of the present invention. The exemplary system 800 may, for example, be implemented in any of a variety of system components or sets thereof. For example, the exemplary system 800 may be implemented in a set top box, personal video recorder, video disc player, surround sound audio system, television, gaming system, video display, speaker, stereo, personal computer, etc.

The system 800 may be operable to (e.g., operate to, be adapted to, be configured to, be designed to, be arranged to, be programmed to, be configured to be capable of, etc.) perform any and/or all of the functionality discussed previously with regard to FIGS. 1-7. Non-limiting examples of such operability will be presented below.

The exemplary system 800 may comprise a communication module 810. The communication module 810 may, for example, be operable to communicate with other systems components. In a non-limiting exemplary scenario, as discussed above, the system 800 may be operable to communicate with an electronic device associate with a listener. Such electronic device may, for example, provide position information to the system 800 (e.g., through the communication module 810). In another exemplary scenario, as discussed above, the system 800 may be operable to communicate with a position-determining system (e.g., a premises-based position determining system) to determine position information. Such communication may occur through the communication module 810. The communication module 810 may be operable to communicate utilizing any of a variety of communication protocols over any of a variety of communication media. For example and without limitation, the communication module 810 may be operable to communicate over wired, wireless RF, optical and/or acoustic media. Also for example, the communication module 810 may be operable to communicate through a wireless personal area network, wireless local area network, wide area networks, metropolitan area networks, cellular telephone networks, home networks, etc. The communication module 810 may be operable to communicate utilizing any of a variety of communication protocols (e.g., Bluetooth, IEEE 802.11, 802.16, 802.15, 802.11, HomeRF, HomePNA, GSM/GPRS/EDGE, CDMA 2000, TDMA/PDC, etc. In general, the communication module 810 may be operable to perform any or all communication functionality discussed previously with regard to FIGS. 1-7.

The exemplary system 800 may also comprise position/orientation sensors 820. Various aspects of such sensors were discussed previously (e.g., in the discussion of FIGS. 4-5). Such sensors may, for example, be operable to determine and/or obtain position information that may be utilized in step 220 of the method 200 illustrated in FIG. 2. Such sensors may, for example, comprise wireless RF transceiving circuitry. Also such sensors may comprise infrared (or other optical) transmitting and/or receiving circuitry that may be utilized to determine location of a listener or other objects in a sound presentation area. Such sensors may also, for example, comprise acoustic signal circuitry that may be utilized to determine location of a listener or other objects in a sound presentation area.

The exemplary system 800 may additionally comprise a user interface module 830. As explained previously, various aspects of the present invention may comprise interfacing with a user of the system 800. The user interface module 830 may, for example, be operable to perform such user interfacing.

The exemplary system 800 may further comprise a position determination module 840. Such a position determination module 840 may, for example, be operable to determine position information associated with a destination for sound (or in other alternative embodiments, for data signals). For example and without limitation, the position determination module 840 may be operable to perform any of the functionality discussed with regard to FIGS. 1-7 (e.g., step 220 of FIG. 2).

The exemplary system 800 may also comprise an audio signal parameter module 850. Such an audio signal parameter module 850 may, for example, be operable to determine (e.g., based at least in part on the determined position information) at least one audio signal parameter. For example and without limitation, the audio signal parameter module 840 may be operable to perform any of the functionality discussed with regard to FIGS. 1-7 (e.g., step 230 of FIG. 2).

The exemplary system 800 may additionally comprise an audio signal generation module 860. Such an audio signal generation module 860 may, for example, be operable to determine position information associated with a destination for sound. For example and without limitation, the audio signal generation module 860 may be operable to perform any of the functionality discussed with regard to FIGS. 1-7 (e.g., step 240 of FIG. 2).

The exemplary system 800 may comprise a processor 870 and memory 880. As explained previously, various aspects of the present invention (e.g., the functionality discussed previously with regard to FIGS. 1-7) may be performed by a processor executing software instructions. The processor 870 may, for example, perform such functionality by executing software instructions stored in the memory 880. As a non-limiting example, instructions to perform the exemplary method 200 illustrated in FIG. 2 (or any steps or substeps thereof) may be stored in the memory 880, and the processor 870 may then perform the functionality of method 200 by executing such software instructions. Similarly, any and/or all of the functionality performed by the position determination module 840, audio signal parameter module 850 and/or audio signal generation module 850 may be implemented in dedicated hardware and/or a processor (e.g., the processor 870) executing software instructions (e.g., stored in a memory, for example, the memory 880). Likewise, various aspects of the communication module 810, functionality associated with the position/orientation sensors 820 and/or user interface module 830 may be performed by dedicated hardware and/or a processor executing software instructions.

The previous discussion provided examples of various aspects of the present invention as applied to the generation of audio signals. It should be understood that each of the various aspects presented previously may also apply to the communication of data (e.g., from multiple sources, for example, multiple antennas). Accordingly, the previous discussion may be augmented by generally substituting "data" for "audio" (e.g., "data signal" for "audio signal"). Additionally for example, the previous discussion and/or illustrations may be augmented by substituting a multiple-antenna system and/or multiple-transceiver system for the illustrated multiple speaker system.

In summary, various aspects of the present invention provide a system and method for performing efficient directed sound and/or data to a user utilizing position information. While the invention has been described with reference to certain aspects and embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An audio presentation method comprising:

determining an initial position in a sound presentation environment;

determining, an initial audio signal parameter that takes into consideration the initial position;

outputting audio to the sound presentation environment according to the initial audio signal parameter; and detecting an environment change to the sound presentation environment that occurs while outputting the audio by detecting that an additional listener is present in the sound presentation environment in addition to an existing listener already present in the sound presentation environment, and in response:

determining an updated position in the sound presentation environment by taking into account both a listener position of the additional listener and a listener position of the existing listener;

determining an updated audio signal parameter that takes into consideration the updated position; and outputting audio to the sound presentation environment according to the updated signal parameter.

2. The method of claim 1, where detecting the environment change further comprises:

determining that the existing listener or the additional listener, or both, has moved to the updated position.

3. The method of claim 1, where determining the initial position, determining the updated position, or both, comprises determining a location of an electronic device present in the sound presentation environment.

4. The method of claim 3, where the electronic device comprises a remote control of a system outputting the audio.

5. The method of claim 1, where determining the initial position, determining the updated position, or both, comprises receiving location information from a cellular telephone.

6. The method of claim 1, comprising determining the updated position based on both a position of the existing listener and a position of the additional listener.

7. The method of claim 1, where determining the initial audio signal parameter, the updated audio signal parameter, or both, comprises determining relative audio signal timing for outputting the audio through multiple output devices.

8. The method of claim 1, where determining the initial audio signal parameter, the updated audio signal parameter, or both, comprises determining relative audio signal timing for outputting the audio through multiple sound emitting elements of an output device.

9. The method of claim 1, further comprising:

repeatedly checking for further environment changes and adapting the audio to take into consideration a detected further environment change.

10. The method of claim 1, further comprising detecting a further environment change when the existing listener or the additional listener has left the sound presentation environment.

11. The method of claim 1, where determining the initial audio signal parameter, the updated audio signal parameter, or both, comprises determining audio signal strength for an output device.

12. The method of claim 1, comprising outputting the audio through multiple output devices; and where the initial audio signal parameter and the updated audio signal parameter are determined for delivering consistent volume of the audio at the initial position and the updated position.

13. The method of claim 1, where detecting that the additional listener is present in the sound presentation environment comprises:

determining that the additional listener is present when the additional listener remains in a particular position in the sound presentation environment for more than a first predetermined amount of time.

14. The method of claim 13, further comprising:

determining a departure of the additional listener from the sound presentation environment when the additional listener is not detected in the sound presentation environment for more than a second predetermined amount of time; and adapting the audio in response to the departure of the additional listener.

15. The method of claim 1, where determining the updated position in the sound presentation environment comprises:

selecting, as the updated position, a position of the existing listener or a position of the additional listener.

16. The method of claim 15, comprising selecting, as the updated position, a listener position of a high priority listener in the sound presentation environment.

17. The method of claim 15, comprising selecting, as the updated position, a listener position most in-line with a main viewing axis of a video display.

18. The method of claim 15, comprising selecting, as the updated position, a listener position closest to a video display.

19. An audio system comprising:

an audio adaptation module operable to:

determine an initial position in a sound presentation environment;

determine, an initial audio signal parameter that takes into consideration the initial position;

output audio to the sound presentation environment according to the initial audio signal parameter; and detect an environment change to the sound presentation environment that occurs while outputting the audio, and in response:

determine an updated position in the sound presentation environment by taking into consideration both a first listener position of a first listener in the sound presentation environment and a second listener position of a second listener in the sound presentation environment;

determine an updated audio signal parameter that takes into consideration the updated position; and output audio to the sound presentation environment according to the updated signal parameter.

20. The system of claim 19, where the audio adaptation module is operable to detect the environment change by determining that the first or second listener in the sound presentation environment has moved to the updated position.

21. The system of claim 19, where the audio adaptation module is operable to determine the initial position, the updated position, or both, by determining a location of an electronic device present in the sound presentation environment.

22. The system of claim 20, where the electronic device comprises a remote control of a system outputting the audio.

23. The system of claim 19, where the audio adaptation module is operable to determine the initial position, the updated position, or both, by receiving location information from a cellular telephone.

24. The system of claim 19, where the audio adaptation module is operable to determine the initial position based on both the first listener position and the second listener position.

25. The system of claim 19, where the audio adaptation module is operable to determine the initial audio signal parameter, the updated audio signal parameter, or both, by determining relative audio signal timing for outputting the audio through multiple output devices.

26. The system of claim 19, where the audio adaptation module is operable to determine the initial audio signal parameter, the updated audio signal parameter, or both, by determining relative audio signal timing for outputting the audio through multiple sound emitting elements of an output device.

27. The system of claim 19, where the audio adaptation module is further operable to:

repeatedly check for further environment changes and adapting the audio to take into consideration a detected further environment change.

28. The system of claim 19, where the audio adaptation module is further operable to detect a further environment change when the first or second listener has left the sound presentation environment.

29. The system of claim 19, where the audio adaptation module is operable to determine the initial audio signal parameter, the updated audio signal parameter, or both, by determining audio signal strength for an output device.

30. The system of claim 19, where the audio adaptation module is operable to:

output the audio through multiple output devices; and where the initial audio signal parameter and the updated audio signal parameter are determined for delivering consistent volume of the audio at the initial position and the updated position.

31. The system of claim 19, where the audio adaptation module is further operable to detect that an additional listener is present in the sound presentation environment by:

determining that the additional listener is present when the additional listener remains in a particular position in the sound presentation environment for more than a first predetermined amount of time.

32. The system of claim 31, where the audio adaptation module is further operable to:

determine a departure of the additional listener from the sound presentation environment when the additional listener is not detected in the sound presentation environment for more than a second predetermined amount of time; and adapt the audio in response to the departure of the additional listener.

33. The system of claim 19, where the audio adaptation module is operable to determine the updated position as a position between the first and second listener positions.

34. The system of claim 19, where the audio adaptation module is operable to determine the updated position as a midpoint position between the first and second listener positions.

35. The system of claim 19, where the audio adaptation module is operable to determine the updated position by:

determining a midpoint position between the first and second listener positions; and skewing the midpoint position to obtain the updated position.

36. The system of claim 35, where the audio adaptation module is operable to skew the midpoint position towards a main viewing axis of a video display, a closest listener position to the midpoint position, a position of an electronic device in the sound presentation environment, or a high priority listener position.

* * * * *